United States Patent [19]

Escallon

[11] Patent Number: 4,526,804

[45] Date of Patent: Jul. 2, 1985

[54] METHOD FOR PROVIDING SHEET METAL STOCK WITH FINELY DIVIDED POWDER

[75] Inventor: Eduardo C. Escallon, Muncie, Ind.

[73] Assignee: Ball Corporation, Muncie, Ind.

[21] Appl. No.: 477,786

[22] Filed: Mar. 22, 1983

Related U.S. Application Data

[63] Continuation-in-part of Ser. No. 412,635, Aug. 30, 1982, abandoned.

[51] Int. Cl.[3] ..... B05D 1/04; B05D 1/06

[52] U.S. Cl. ..... 427/32; 427/27; 427/185; 427/195

[58] Field of Search ..... 427/27, 32, 29, 185, 427/195

[56] References Cited

U.S. PATENT DOCUMENTS

| | | | |
|---|---|---|---|
| 3,257,116 | 6/1966 | Sharetts | 427/185 |
| 3,560,239 | 2/1971 | Facer et al. | 427/185 |
| 4,066,803 | 1/1978 | Scholes et al. | 427/27 |
| 4,068,039 | 1/1978 | Larson et al. | 427/29 |
| 4,088,809 | 5/1978 | Elbling et al. | 427/32 |
| 4,230,068 | 10/1980 | Itoh et al. | 427/348 |
| 4,288,466 | 9/1981 | Heckman et al. | 427/28 |
| 4,297,385 | 10/1981 | Banucci et al. | 427/27 |
| 4,325,988 | 4/1982 | Wagner | 427/180 |
| 4,343,641 | 8/1982 | Scholes | 427/29 |

OTHER PUBLICATIONS

Harris, S. T., "The Technology of Powder Coatings", Portcullis Press, London, 1976.

Matheson, G. L., W. A. Herbst, and Ph. H. Holt, 2nd, "Characteristics of Fluid-Solid Systems", *Industrial and Engineering Chemistry*, vol. 41, pp. 1099–1104, 1949.

*Primary Examiner*—Richard Bueker

*Attorney, Agent, or Firm*—Gilbert E. Alberding

[57] ABSTRACT

A method and apparatus for coating a metal substrate with a finely divided powdered material, which method includes the steps of providing a supply of resin particles adjacent a coating zone, releasing a gentle flow of gas through the supply of resin particles to permit the particles to flow freely, delivering a uniform flow of particles to a comminuting site, releasing the fluid energy of a compressed gas to the flow of resin particles to impart sufficient momentum to said resin particles to reduce their average particle size to a very finely divided resin particle size of 10 microns or less, providing a flow of finely divided resin particles and diffusing the flowing gas to provide a substantially quiescent, slowly and upwardly moving gas stream to maintain the very finely divided resin particles segregated in a uniform cloud and to carry said cloud to the coating zone; confining said cloud of very finely divided resin particles in the coating zone, said particles having a diameter-to-weight ratio such that they will remain suspended in the substantially quiescent atmosphere of the coating zone; moving sheet metal stock to be coated in strip form through the coating zone; and providing an electric charging and depositing field terminating on the metal stock strip in the coating zone having a potential gradient sufficient to charge the finely divided resin particles and deposit said particles on the metal surface while the particles are in a repelling relationship with respect to one another thereby providing a uniform distribution of particles on the strip.

26 Claims, 14 Drawing Figures

METHOD FOR PROVIDING SHEET METAL STOCK WITH FINELY DIVIDED POWDER

BACKGROUND OF THE INVENTION

This patent application is a continuation in part of U.S. patent application Ser. No. 412,635 filed Aug. 30, 1982, now abandoned.

This invention relates to a method and apparatus for providing means for coating sheet stock, especially metal strip, with a finely divided powder, and, more particularly, to a novel method and apparatus for conveying a finely divided powder in a manageable state and transmitting the same to a deposition zone, especially to an electrostatic device, whereby the powder is uniformly coated upon a moving metal strip.

Strips used to make metal containers and container ends, such as beer, soft drinks and the like, are given a coherent coating of a resinous or polymeric material that must be free of pinholes, sufficiently flexible to permit extreme distortion accompanying the fabrication of the containers and container ends, yet inexpensive so that such containers and ends are not uneconomical in their manufacture.

In order to meet these requirements, it is advisable that such coatings be cohesive, flexible, inert and very thin and uniform in thickness. In the past, film-like coatings of resinuous or polymeric materials have been commercially formed on the metal stock by numerous means including kiss plate and roller-coated devices. In these wet methods, organic as well as inorganic solvents or carriers have been used as the means to transport and spread uniformly the resinous materials. In such processes, the carrier for the resinous material must be removed, generally by the application of heat. When the resinous material is carried by a hydrocarbon solvent, which is generally the case, it is necessary to control the emission of the solvent or carrier in order to comply with governmental regulations. Such compliance frequently calls for the use of special collecting devices or incinerators to oxidize or combust the organic materials.

The direct use of powdered resins without solvents onto a given substrate to achieve coatings has been desirable and has been suggested in the art. Presently known techniques are of various types. A method that may appear to be closely allied to the subject invention employs a fluidized bed. In a fluidized bed technique, the substrate to be coated is usually heated just above the melting point range of the resinuous material being used to coat the substrate. The substrate is then immersed or allowed to pass through, usually for only a few seconds, the fluidized bed of particles of said resinuous material. Some of the particles stick to the immersed substrate and upon removal from the bed, the residual heat melts and levels the adhering particles in a smooth, non-porous resinuous coating.

Prior to this invention, however, there has been no commercially satisfactory method of forming a very thin powder coating, that is, a coating of resinuous or polymer material in the range of about 0.5 mils and less. The main reason for this is that when the thickness of the powder coating is required to be very thin, it is difficult to handle or dispense finely divided powdered material in a continuous manner to meet commercial requirements. Although it may appear that coating a substrate with very fine powder would be a straightforward endeavor, it has proven to be a formidable problem requiring substantial effort. In S. T. Harris's standard textbook for the powder coating industry, "The Technology of Powder Coatings" (Portculler Press, London 1976, page 290), it is stated that although fine grinding may be accomplished to make fine powders, it is difficult to apply these fine powders to substrates for each fine powders are not easily handled and dispensed, such as by fluidization, and, moreover, are not deposited as readily as larger particles when applied electrostatically. The difficulty of such handling techniques, such as fluidization, is further borne out by G. L. Mathenson, et al., in an article entitled "Characteristics of Fluid-Solid Systems," Ind. Eng. Chem., 41:1099 (1949) disclosing that very small particles with diameters less than about 10 microns give rise to cohesive attraction of the particles themselves during fluidization, causing balling of the particles during fluidization and, sometimes, agglomerated spheres up to several millimeters in diameter.

A number of prior art patents disclose particular techniques of coating electrostatically powdered material. However, none have proved usable on a commerical sale to accomplish the cohesive, flexible, inert and very thin uniform coatings of this invention. A number of prior patents have been directed to the development of resin powders for coating. Among the examples of such patents are: U.S. Pat. Nos. 3,058,951; 3,781,380; 4,009,223; 4,009,224; 4,072,795; 4,092,295; 4,104,416; and 4,312,902. Several of these patents are specifically directed to powders for electrostatic deposition; e.g., U.S. Pat. Nos. 4,009,223; 4,072,795; and 4,104,416. Other patents have been directed to electrostatic coating processes and apparatus, for example, U.S. Pat. Nos. 3,336,903; 3,593,678; 3,670,699; 3,690,298; 4,066,803; 4,073,966; 4,084,018; 4,101,687; 4,122,212; 4,209,550; 4,230,668; 4,244,985; 4,285,296; and 4,297,386. Many of these patents are specifically directed to the electrostatic deposition of resin powders; e.g., U.S. Pat. Nos. 3,336,903; 3,670,699; 3,690,298; 4,084,108; 4,101,687; 4,122,212; and 4,230,068.

Several patents disclose coating of the inside of metal beverage containers with powdered resins; e.g., U.S. Pat. Nos. 4,068,039 and 4,109,027 and the development of powdered resins for food and beverage containers. A method of coating a non-metallic substrate with finely divided particles is disclosed in U.S. Pat. No. 4,325,988.

SUMMARY OF THE INVENTION

This invention provides a novel method and apparatus for providing metal stock with coherent, uniform, functional coatings of less than 0.5 mils in thickness and as low as 0.05 mils in thickness. Such coatings are formed from powdered resins or polymeric material, preferably thermosetting epoxy powders, having average particle sizes in the ranges from 15 to about 1 microns, and preferably with average particle sizes less than 10 microns. In the process of this invention, very fine particles are generated proximate to and delivered toward a coating zone, the particles being conveyed in a substantially unpacked state, free from agglomeration into an electrostatic charging and deposition zone at coating efficiencies of typically about 80 to 90 percent. The method and apparatus of the invention provide not only improved metal stock but, more importantly, the economical manufacture of such stock. Moreover, the invention provides a novel method of conveying finely divided materials to render them free flowing and highly manageable whereby said materials are caused to flow at predictable, controlled flow rates into a deposition area, especially into an electrostatic field. In processes such as these in which finely divided materials have to be handled, bad manageability means an impediment in processing and/or the efficient application of uniform coatings. This aspect is critical for the reasons hereinafter discussed since finely divided materials, as is well known, become less manageable in proportion as the particles are smaller.

In general, particulate materials may be divided into two broad classes, depending on their flow properties, viz., cohesive and non-cohesive. Whereas non-cohesive materials like resinous grains readily flow out the opening of an enclosure, cohesive solids, such as wet clay are characterized by their reluctance to do so. It will be appreciated that non-cohesive materials have a natural tendency to cling to or interlock with one another under gentle pressure and generally will not slide over one another until the applied force reaches an appreciable magnitude. Granular solids, unlike most fluids, resist distortion when subjected to at least some distorting force, but when the forces are large enough, failure occurs, and one group of particles will readily slide over another, but between the groups on each side of the failure there will be appreciable friction. In this regard, there is a close analogy between the flow of particulate material, and that of plastic non-Newtonian liquids.

An important and distinctive property of particulate matter is that the densities of the masses will vary, depending on the degree of packing of the individual grains. The density of a fluid is a unique function of temperature and pressure, as is that of each individual solid particle; but the bulk density of a mass of particles is not. The bulk density is a minimum when the mass of particles is in a loose or unpacked condition, and it may be readily increased to a maximum when the mass is packed by vibrating or tamping. It goes without saying that bulk density is an important characteristic in handling particulate matter.

It is well known that a number of factors affect the general flow properties of finely divided particles and include, particle size particle geometry, cohesive forces, adhesive forces, the presence of moisture, size segregation, electrostatic charge acceptance in triboelectrification, density, presence of flow aids, packing or bulking density and readiness of powders to compact or pack in storage.

It is important in following the process of the subject invention that the finely divided particles not be allowed to agglomerate once they are formed. Any handling or process step should be considered from the point of view of not materially changing the density characteristic or bulk density properties of a stream of the powdered material. The comminution of the materials produces static electricity, and this static electricity could have the deleterious effect of causing agglomeration of the particles. As can be appreciated, the particles that have been reduce in size tend to reagglomerate. Agglomerated particles are difficult to separate and pulverize.

In addition, cohesive flow is primarily encountered with very fine particles; in particular, when the particles are substantially less than 10 microns in size, interparticle attraction becomes severe, resulting in their agglomeration. This agglomeration of particles is often distributed in random fashion throughout the mass, resulting in a mass that may appear to be uniform in particle distribution but, in fact, will be disseminated with a multiplicity of agglomerated particles in a random fashion. It follows that agglomeration in this form has some effects on the overall flow characteristics of the mass.

A mass of uncompacted or substantially uncompacted particles may be formed by redistributing the mass to obtain a predetermined degree of uniform packing or, put otherwise, a degree of fluffiness of particles. In effect, this tends to remove agglomerations of particles from the mass. Uncompacting the particulate mass improves the flow characteristics of the particulate matter so that a more uniform flow of particles can be obtained. Simply obtaining a substantially uncompacted particulate mass relatively free of agglomerated sites is most advantageous. To be more fully described hereinafter, such uncompacting can take place, for example, in a fluidized bed or a fluid energy mill. Attention to maintaining a uniform state of particulate matter during its processing has somehow been unappreciated by other workers and is believed to contribute significantly to the achievement of results obtained by this invention, results heretofore unobtainable in the formation of very thin uniform coatings or films from finely divided powders.

In the instant invention, particles of resin are provided adjacent the coating zone. The particles of resin are uncompacted and subjected to the intense energy released by the expansion of compressed gas and are thereby given sufficient momentum to comminute and otherwise reduce the particles to a very fine particle size. The energy of the expanding gas is further diffused to provide a gentle, almost quiescent, flow that is sufficient to transport the finely divided particles. The particles themselves have a surface-to-mass ratio sufficient that they are moved by the gentle flowing gas against the effect of gravity, and generally upwardly into a deposition zone. Such surface-to-mass ratios may be, for example, from 300 to over 1,000 reciprocal gram centimeters.

In the coating zone, the powdered particles are in a quiescent cloud and a metal strip to be coated is preferably moved through the quiescent cloud and exposed to electrical energy to create an electric field of sufficient intensity to charge and deposit the powdered particles. In effect, the charged particles move in response to the electric field and are deposited on the surface of the metal strip.

It is believed that because the resinous or polymer material of the particles has a very high resistivity, the deposited particles, except for that portion of the surface in direct contact with the stock or strip, maintain an electrostatic charge on those portions remote from the surface. Retained electrostatic charge on the deposted particle will repel and resist the deposition of other like-charged particles being deposited on the strip in the vicinity of deposited particles and tend to lead to a more uniform distribution of discrete particles over the entire surface of the strip. The retained particle charge and the small size of the deposited particles result in their secure adherence to the surface of the strip.

Apparatus of the invention includes first means forming a deposition chamber. The strip to be coated is moved by second means through deposition zone. The second means preferably moves the strip through the deposition chamber horizontally with its surfaces to be coated lying in a vertical plane, generally adjacent the center line of the deposition chamber. The source of powdered material, or third means, lies adjacent the end of the deposition chamber at which the strip enters. The third means supplies uncompacted powder to the source and grinds, abrades, or otherwise reduces the size of the powder to a very fine particle size prior to the delivery to the deposition chamber. Several different forms of such third means may be used to provide a source of very fine powdered material, but it is preferable that the particles be subjected to the energy release of a compressed gas to provide energy to reduce the particles, and their delivery to the deposition zone be under the influence of the diffuse and gentle flow of this gas. Such third means will carry the particles with their high surface-to-mass ratio to the deposition zone while maintaining the particles segregated and free from agglomerations. A fourth means carries the uniform distribution of particles in a gently flowing quiescent cloud into the deposition chamber free of agglomerations. Fifth means within the coating zone electrically charge and deposit the particles on the stock. The fifth means can include electrodes electrically isolated from, but supported within, the deposition chamber, preferably on each side of the metal strip. These electrodes are connected with a source of high voltage sufficient to charge and deposit the particles on the stock.

In this invention, stock upon which the coherent films to be formed is moved through the deposition chamber, for example, at speeds up to 200 feet per minute. The powdered material that has been formed in the adjacent source is delivered into the deposition chamber in a substantially quiescent cloud. High voltage is applied to the electrodes within the deposition chamber which are preferably so arranged that an average potential generally in excess of 20,000 volts exists between the electrodes and the strip so that current densities within the deposition zone exceed 15 microamperes per square foot. Creation of such electric power in the coating zone will charge and deposit the particles upon the strip.

In the instant invention, as much as 80 to 90 percent of the particles introduced into the deposition chamber may be deposited upon a strip, such as metal stock, as it passes through the chamber. Any remaining powder may be collected and reused. With this invention, ultra-thin uniform coherent films can be formed on both sides of a strip of metal stock. The metal strip is specially adapted for manufacture into metal beverage containers and the coated strip is capable of surviving severe deformation associated with metal container production without a break in the coherency of the film or coating and without imparting an unpleasant taste to the contained beverage.

DESCRIPTION OF THE DRAWINGS

Further features and advantages of the invention will be apparent from the following description and drawings in which.

DESCRIPTION OF THE PREFERRED EMBODIMENTS

Figure 1:
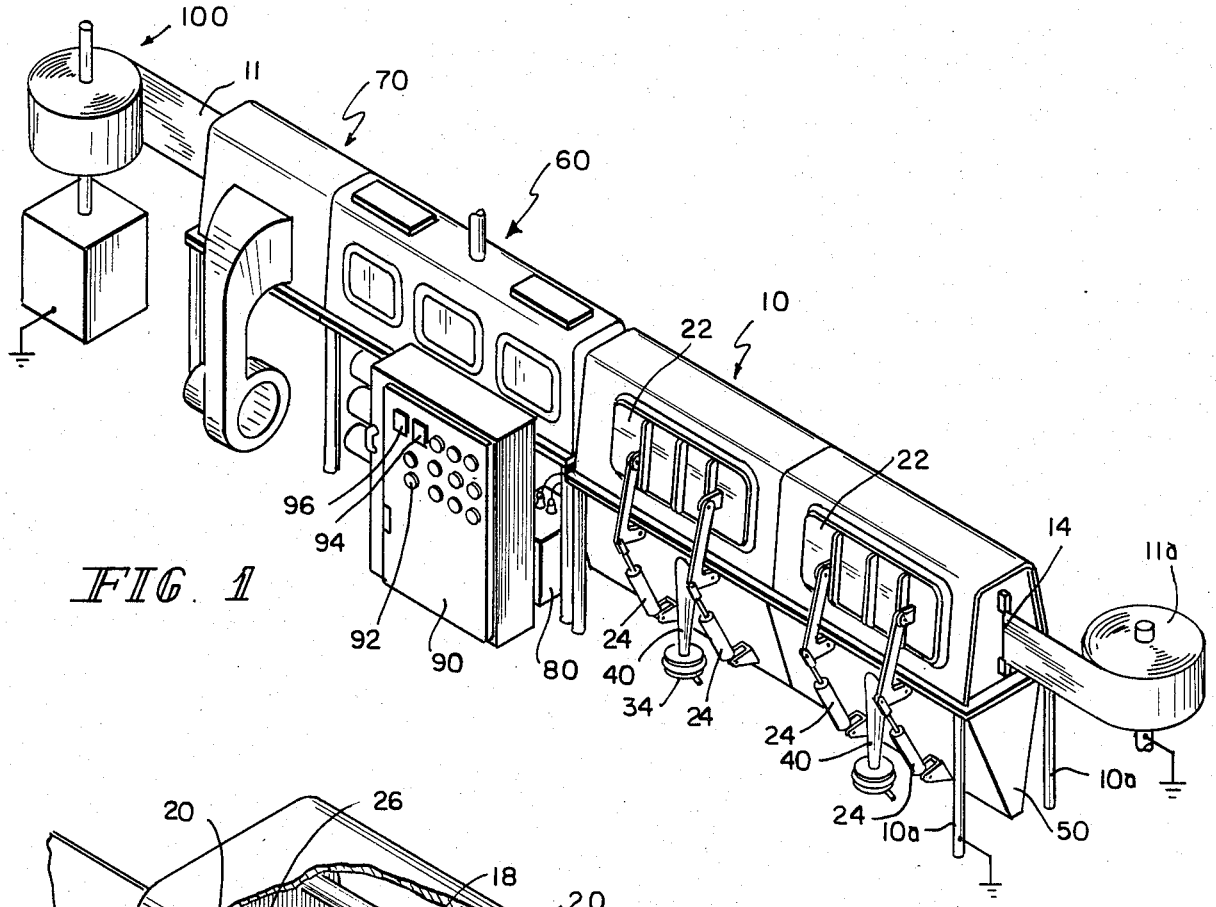
FIG. 1 is an external perspective view of a typical installation illustrating use of this invention.

FIG. 1 shows a coating system to illustrate the use of this invention. The powder supply system of this invention has been excluded in part from FIG. 1 to simplify this view of the invention's use. As shown in FIG. 1, a structure 10 defines a deposition chamber 12 (shown in FIG. 4). Finely divided particles of coating material are introduced to the deposition chamber through that part of the powder delivery system shown in FIGS. 1 and 4. The structure 10, and its deposition chamber 12, is the means used to form a coating zone in which the finely divided particles, for example, having particle sizes less than 10 microns, are deposited on a moving metal strip 11.

Figure 4:
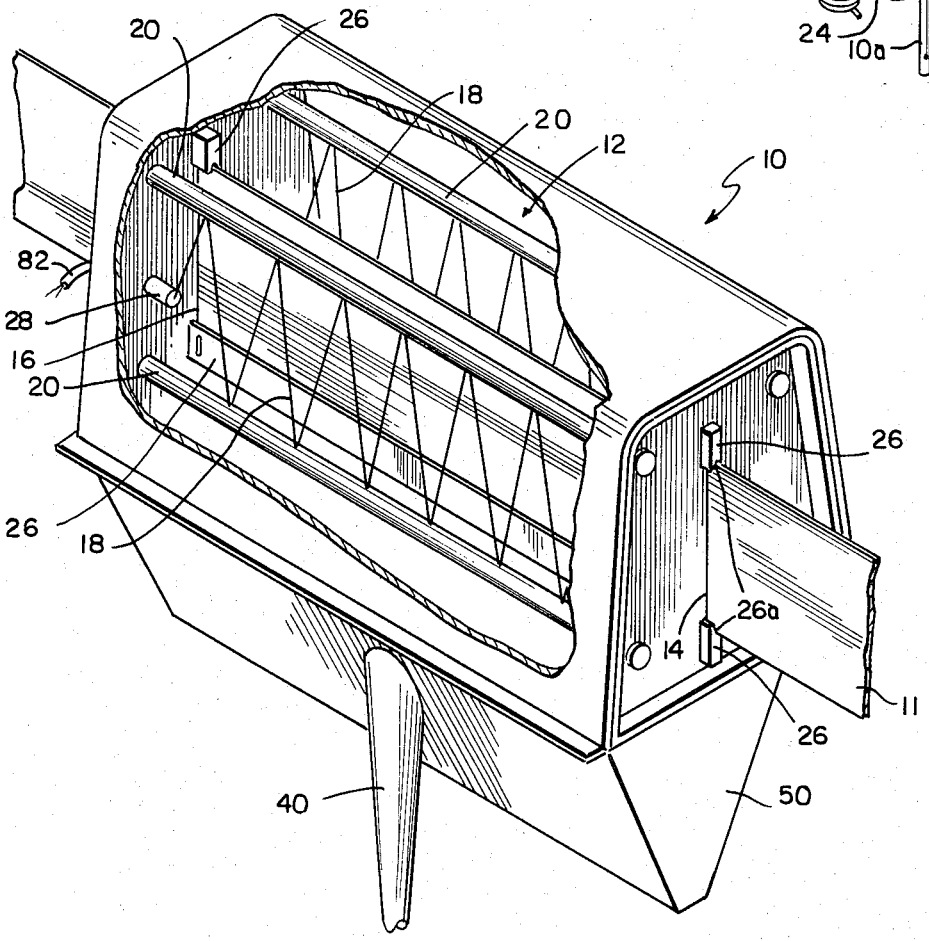
FIG. 4 is a partial cross-sectional view of the means forming the coating zone and the charging means of the apparatus of FIG. 2.

The metal strip 11 is generally in coiled form (11*a*) prior to coating. To coat the strip metal, the strip 11 is fed through the deposition chamber 12 by its inlet slot 14 and its outlet slot 16, as shown in FIG. 4. In the apparatus shown in FIG. 1, two deposition chambers, each like deposition chamber 12 of FIG. 4, have been included to define the coating zone within structure 10. The coating zone structure has been conveniently arranged in modules to permit the coating zone to be expanded if desirable. It has been found convenient to provide a module structure forming a deposition chamber having a length of four feet along the path of strip movement.

As shown in FIG. 4, the coating zone within deposition chamber 12 includes an array of electrodes 18 arranged on both sides of the strip 11. The electrodes shown are fine wires supported between insulators 20. The electrodes 18 are connected with a source of high voltage 80 to provide high voltage and current to the coating zone and an electric field to the metal strip 11. One side of the high voltage supply output and the metal strip 11 are grounded. ;p Upon leaving the means 10 forming the coating zone, the strip 11 is fed through an oven 60 and a cooling section 70 and onto a strip drive 100. Strip drive 100 provides the means to move the metal strip 11 through the apparatus.

An electrical control 90 for the apparatus includes pushbuttons, e.g., 92, to operate electrical contactors for the high voltage supply 80, the powder delivery system 30, the oven 60, the cooling section 70 and the strip drive means 100 and other parts of the apparatus. Where the apparatus has more than one coating zone module, it may be provided with a separate high voltage supply for each coating zone although this is not necessary. The control may also provide a meter 94 indicating the output voltage of the high voltage supply and a meter 96 showing the temperature within oven 60. Other meters, controls, and interlocks between the various controls may be provided as known to those skilled in the industrial controls art.

In operation of the apparatus of FIG. 1, the metal strip is moved by the drive means 100 through the coating zone. Coating material particles are provided to the deposition chambers 12 by powder delivery systems 30. High voltage and current are provided to the electrodes 18 within the deposition chamber and an electric field is created between the electrodes 18 and the metal strip 11. Because of the electrode shape, magnitude of voltage, and proximity of the electrodes to the metal strip, the particles of coating material become charged and deposited on the metal strip. As the coated metal strip moves through oven 60, the particles are fused to the metal in the form of a very thin coherent film. The coated metal is then cooled in cooling section 70 and recoiled by the strip drive means 100. A more detailed description of the inventive aspects of this invention follows.

Figure 2:
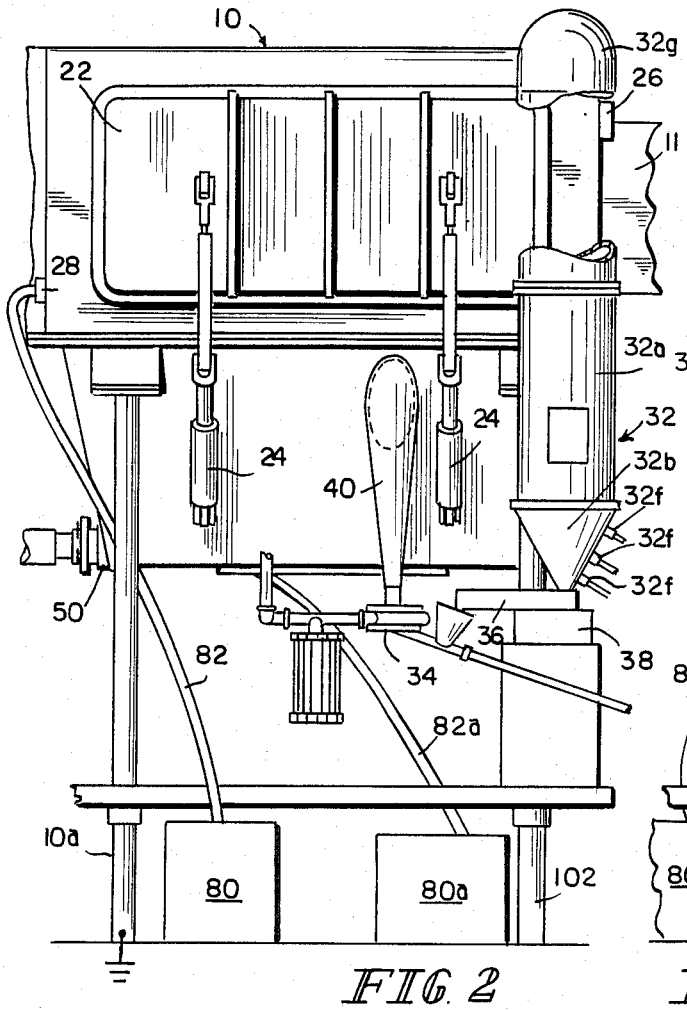
FIG. 2 is a side elevational view of a means forming the coating zone of this invention.
Figure 3:
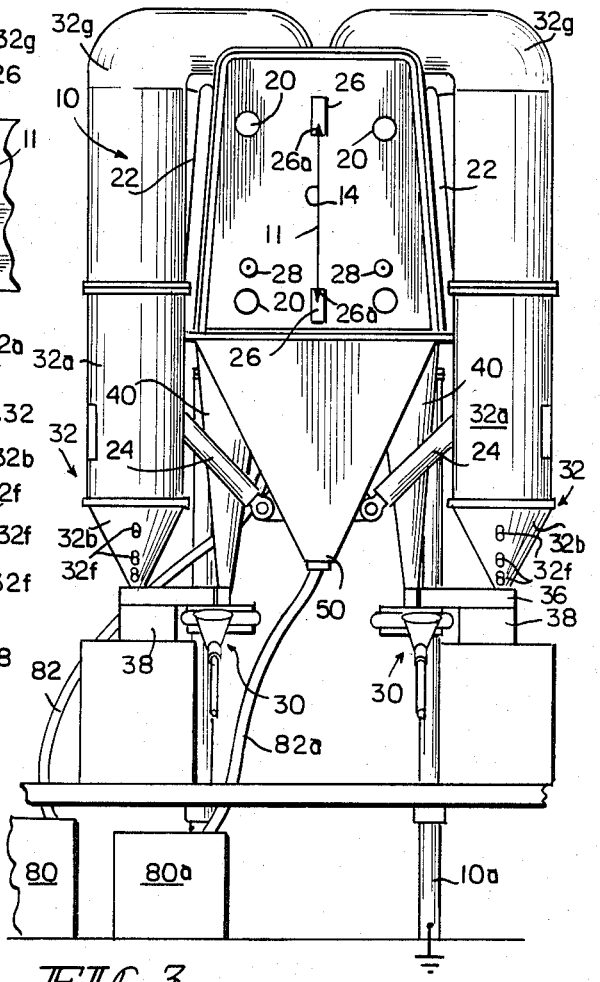
FIG. 3 is an end view of the apparatus of FIG. 1.

FIGS. 2–4 show the coating apparatus in greater detail. The structure 10 forming the coating zone, as shown in FIGS. 2 and 3, is preferably constructed of steel and grounded. The structure 10 may be supported on a plurality of metal tubes 10*a* which may be grounded to the high voltage supply. As shown in FIG. 2, the structure 10 may be provided with removable side panels 22 which may be dropped from their position by mechanisms 24 including hydraulic or pneumatic cylinders. The hydraulic or pneumatic cylinder of the mechanisms 24 to open the side panels 22 may be operated from the electrical control 90 (FIG. 1). The panels 22 may be provided with windows of clear plastic, such as General Electric's LEXAN material, to permit observation within the deposition chamber 12.

As shown in FIG. 3, the metal strip 11 moves through the deposition chamber 12 with its surfaces to be coated travelling in a vertical plane. The strip 11 is supported and guided through the deposition chambers by a plurality of supports 26 which are preferably a lubricous, rigid, and wear-resistant thermoplastic material such as polypropylene, nylon, or the like. The strip guides 26 are formed with slots 26*a* into which the strip is threaded and in which the strip travels during operation of the apparatus.

Where the metal strip 11 is driven through the deposition chamber 12 at higher rates, it can create stationary rotational air movement on each side of the strip 11 adjacent the exit and entrance openings within the deposition chamber. Such vertical air movement reduces the quality of particle deposition. Where a coated strip is to be produced at such higher rates, for example, in excess of about 100 feet per minute, it is preferable that the means forming the deposition chamber 12 be provided with inwardly curving end walls adjacent the entrance and exit openings.

Figure 13:
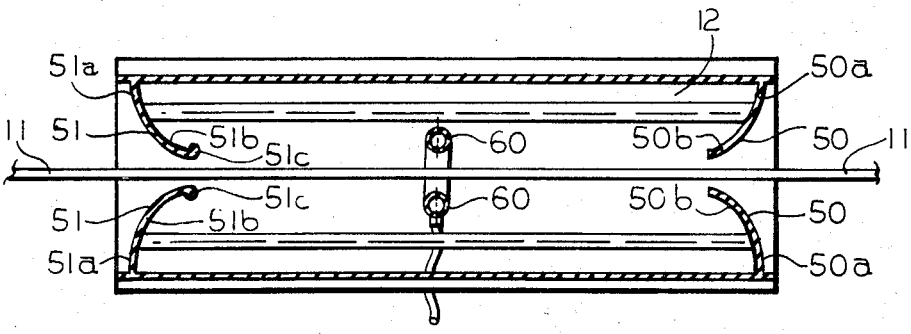
FIG. 13 is a cross-sectional view from above of the means forming the deposition chamber adapted for higher production rates.

FIG. 13 is a cross section, for example, of a deposition-forming means like that of FIG. 4, on a plane horizontally through its central portion to show such an end wall transition. Such end walls 50, 51 curve inwardly from the portions 50*a*, 51*a* of the end walls perpendicular to the strip and terminate adjacent the entrance and exit openings with portions 50*b*, 51*b* approaching parallel to the strip. The walls may, preferably, form elliptically curved walls interiorly of the deposition chamber at both sides of the entrance and exit openings. This curving transition adjacent the entrance and exit openings precludes the harmful stationary rotational air flows. To assist in the prevention of harmful air flow within the deposition chamber, a radial termination 51*c* is provided on the termination of the inwardly curving wall adjacent the exit opening. Such a radial termination may be formed by rolling the end of the wall into a generally cylindrical termination.

The electrode insulator assemblies 18, 20, are arranged in vertical planes on either side of the metal strip 11, as shown in FIG. 3. An electrical field is formed between the electrodes 18 and the metal strip 11 transverse to the path of travel of metal strip 11 within the deposition chamber 12 when voltage is applied to the electrodes 18 from the high voltage supply 80 through high voltage cable 82. As shown in FIG. 4, the voltage from high voltage cable 82 is delivered to the high voltage feed through insulator 28 for connections to the electrodes 18. The electrode 18, as shown in FIG. 4, is a small-diameter steel wire, having, for example, a diameter on the order of 0.010 inch that is suspended between a pair of insulators 20 as described above. The small-diameter wire electrodes, when connected to voltages in excess of 20,000 volts, ionize the atmosphere within the deposition chamber adjacent the wires and create a flow of electrical ions transversely across the deposition chamber to the grounded metal sheet. The electric field and ionization created by the electrodes 18 result in a deposition of particulate matter introduced to the deposition chamber. The distance between the central vertical plane of the deposition chamber along which metal strip 11 moves and the vertical planes on either side of the metal strip in which the electrodes 18 lie may be varied, but preferably lies within a range of three to twelve inches. If desired, the electrodes 18 on either side of the metal strip 18 may be provided with differing voltages by an additional high voltage supply 80*a* and an additional high-voltage cable 82*a*. It must be understood, however, that independent control of the electrodes on either side of the metal strip is generally unnecessary.

FIGS. 2 and 3 illustrate more completely the means 30 adjacent the coating zone to provide material particles to the deposition chamber. Such means include hoppers 32 to provide a supply of unpacked resin particles and a fluid energy mill, or micronizer 34 to reduce the resin particles to a finely divided size having an average particle size of less than 10 microns and to transmit them to means 40 to introduce the finely divided particles as a uniformly distributed, gently flowing cloud of very fine particles.

As depicted in FIGS. 1–4, the particles generated by the powder system 30 are directed upwardly by conduits 40 of increasing cross section that communicate with the entrance portion of the deposition chamber, preferably within about six inches of the inlet slot 14.

In the past, considerable difficulty as been encountered in utilizing supplies of powdered materials that are advanced through various enclosure means such as funnels, hoppers and other devices, especially those having converging walls with an associated opening for dispensing the powdered material. Such powdered materials are prone to form clumps above and within the dispensing devices, especially as they issue from the opening whereby the powdered material is limited or prevented from flowing. To achieve predictable, controlled flow rates through an opening or along a path, the mere use of vibratory devices, which often acts to dislodge clumps that impede flow, does not resolve the problem, especially when dealing with very fine powdered materials since they are prone to clump and agglomerate easily in attempting to issue from an opening. Thus, where continuous flow rates are required, especially low flow rates through reduced orifices for dispensing the material, there is an increase in the agglomeration effect. Simply increasing vibratory energy produces a diminishing return, that is, further vibratory energy yields no improvement in flow but merely causes the material to pack into a solid mass.

Powdered materials having high bulk densities, say below about 35 pounds per cubic foot, are particularly difficult to feed because of variations in bulk density and, hence, do not meter accurately. As previously stated, the utilization and maintenance of substantially unpacked particulate matter has overcome this problem. It is therefore necessary in the subject invention to provide a stream of particles or powdered material in an unpacked condition which, in turn, assures the delivery of an essentially uniform or constant mass-rate. Delivery of powdered material in a substantially unpacked condition and at a substantially constant mass-rate is obtained by using this invention.

Figure 5:
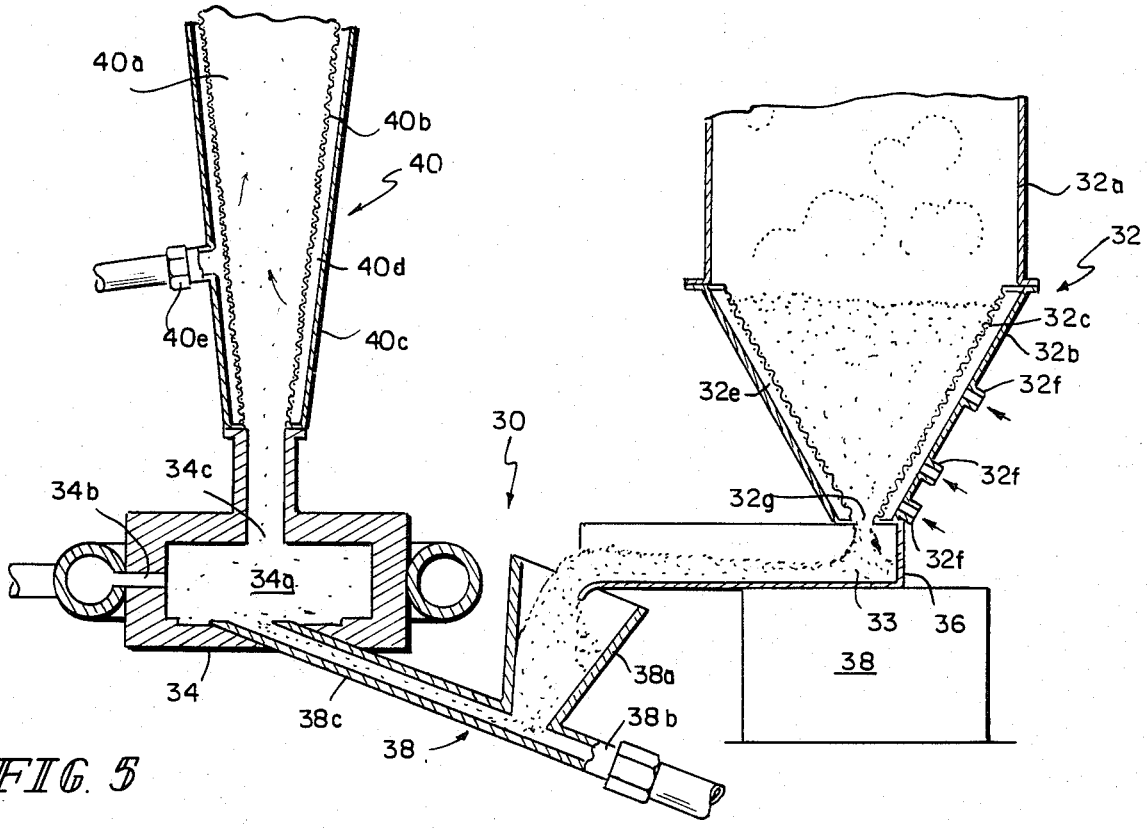
FIG. 5 is a partial cross-sectional view of a source of ultra-fine particles of this invention.

FIG. 5 shows, in greater detail, the powder delivery system of this invention that is shown in FIGS. 1–4. The means shown in FIG. 5 can provide a flow of unpacked resin particles and can finely divide the resin particles to reduce their size to an average particle size of less than 10 microns. At the bottom of a hopper 32*a* is a funnel-like portion 32*b*. The portion 32*b* includes a frustoconical inner wall 32*c* and a frustoconical outer wall 32*d*, forming a plenum 32*e* that is connected with a source of compressed air through fittings 32*f*. The inner frustoconical wall 32*c* is formed of an air-pervious material, thereby permitting a relatively uniform flow of air and fluidizing and unpacking the powder particles adjacent the exit 32*g* of the hopper 32. Uncompacted particles 33 thus flow freely from the opening 32*g* into trough 36 which is vibrated by vibrator or vibratory feeder 38. The uncompacted particles 33 travel as a result of the vibration of trough 36 to an injector assembly 38 including a funnel 38*a* and an injection nozzle 38*b* which is connected to a source of compressed air. The powder is carried by the flow of compressed air through a conduit 38*c* of the injector assembly 38 and into a central chamber 34*a* of the fluid energy mill or micronizer 34.

Although not necessary, it is sometimes advantageous to remove the ultra-fine particles or fines from commercial grade resinous materials. The fines, particles that have an average particle size of well less than 5 microns, and because of their size may be readily removed directly from the aerator 32 by placing a secondary conduit as shown in the drawings, an L-shaped housing 32*g* communicating directly into the deposition chamber 12 and allowing the fines to be carried over by auxiliary air directors 41 situated within the secondary conduit.

Apparatus for forming finely divided particles (i.e., particles with an average particle size less than 10 microns) are known. Such apparatus may be a fluid energy mill or micronizer, as sold by the Sturtevant-Mill Company of Boston, Mass. The operation of such fluid energy mills is well known in chemical engineering, and an application of a micronizer in a coating operation is disclosed in U.S. Pat. No. 4,325,988. The very fine particles of this invention are formed from particles of resin in the comminutor 34 located adjacent the deposition chamber.

The source of finely divided particles shown in FIG. 5, includes such a fluid energy mill. In such a system, coating material particles, for example, having sizes in the range of 25 to 40 microns provided from powder supply 32 are reduced in particle size to 10 to about 1 micron range of diameter. A gas, such as compressed air, is fed into a comminutor chamber 34*a* at a plurality of sites 34*b*. The energy of the compressed gas is released to form high velocity jets of air which impart high energy to the particles of resin so that the particles fracture each other by violent shearing impact, as well known in the operation of fluid jet mills. Centrifugal force keeps the oversize particles in the peripheral grinding zone and the very fine, comminuted particles flow to the center of the grinding chamber which is provided with an opening 34*c* to permit their removal. These particles are withdrawn from the comminutor 34 by the outflowing gas.

Passageway 40*a* is formed by an air-pervious conical inner wall 40*b*. The outer wall 40*c* with the inner wall 40*b* form a plenum 40*d* which is connected to a source of compressed gas through fitting 40*c*, and the compressed gas flows uniformly through inner wall 40*c*. In accordance with the invention, means 40 forming a diffusing passageway 40*a*, or fourth means, is connected in communication with the means 30 providing the supply of very finely divided coating material particles. Means 40 further diffuses the momentum of the compressed gas and provides a gentle, almost quiescent flow of particles and gas to the deposition chamber 12. The gentle flow of gas maintains the finely divided particles segregated and discrete, one from the other, in a uniform quiescent cloud; and the quiescent flowing cloud of finely divided particles is introduced into the deposition chamber 12.

Figure 6:
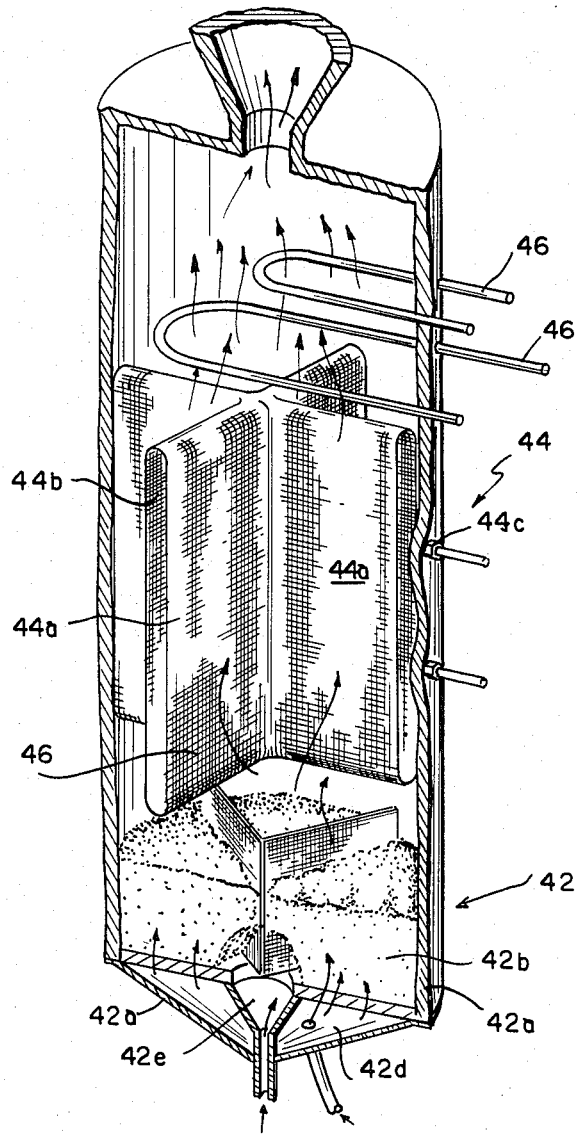
FIG. 6 is a partial cross-sectional view of another source of ultra-fine particles of this invention.

FIG. 6 shows another method and apparatus for achieving finely divided particles. This apparatus includes a fluidized bed structure 42 which includes walls 42*a* defining a container 42*b*, an air-permeable bottom 42*c*, and a plenum 42*d*. The fluid bed structure 42 contains and provides the means to uncompact the resin particles. Thus, the powder to be converted to finely divided particles is placed on an air-permeable bottom 42*c* of the container. The plenum 42*d* below the air-permeable bottom 42*c* is pressurized to provide a uniform outward flow through the air-permeable base sufficient to lift the powder against the force of gravity. The air-permeable bottom may be, for example, #237 Nylon monofil 20 micron mesh bolting fabric made by Newark Wire Cloth Co. of Newark, N.J. The fluidized bed 42 further includes a second plenum 42*e* located centrally within the plenum which is connected to a higher pressure. A reservoir is formed by wall portion 44 located above and continuous with the fluidized bed container 42. The reservoir includes inner walls 44*a* and central surfaces of abrasive material extending centrally within the reservoir. When the second plenum 42*e*, located centrally within the fluidized bed container 42, is pressurized, a plume 46 is formed, as shown in FIG. 6, which directs the particles of resin upwardly and in contact with the central surfaces and inner walls 44*a* of the reservoir for grinding and abrasion. The finely divided particles formed thereby are carried with the outflowing gas through the passageway 40 upwardly into the deposition chamber and coating zone.

Because the inner walls and surfaces 44*a* of the fluid bed container reservoir may accumulate powder particles, they are adapted to form a plenum 44*b* that is connectable with a source of gas under high pressure through fitting 44*c*. Periodic pressurization of these plenums clears the inner surfaces of the reservoir of the collected powder particles so that they do not interfere with the further production of finely divided particles from the larger resin particles. Typical of the materials that can be used to provide the inner abrasive surfaces is a woven fabric having deposited on its outer surface, carbide grit. These woven fabrics can be obtained in a multiplicity of mesh sizes and are effective in providing abrasion of the resin particles sufficient to reduce their particle size to the range of 15 to about 1 micron.

Above the reservoir portion 44, supplementary air may be introduced within the system through a series of perforated tubes 46 that are connected with a source of compressed gas.

Within the deposition chamber, particles are deposited from the quiescent cloud by the electric field from the electrodes to the conductive substrate. The electric field is established within the deposition chamber by the plurality of electrodes, preferably wire having a diameter on the order of 0.010 mils, distributed uniformly within the deposition chamber on either side of the central plane of deposition chamber.

As one example, the system of electrodes can include a plurality of wire electrodes spaced 6 inches apart and having a length on the order of 18 inches. The electrodes typically extend in vertical planes which are spaced 3 to 6 inches from the central plane upon which the metal sheet generally travels. Thus, in a 12-foot coating chamber, 24 electrodes may be used on each side of the metal sheet. A source of high voltage capable of providing voltages from 20,000 to 60,000 volts and currents of from 1 to 4 milliamperes completes the fifth means. Within the deposition chamber average voltage gradients of 3,000 to 15,000 volts per inch and current densities from 20 to 50 microamperes per square foot can be created. This electric power is consumed in providing ionization and electric wind and the charging and deposition of ultra-fine particles on sheets moving as fast as 200 square feet per minute at rates of about 8 grams per square foot per minute.

Figure 7:
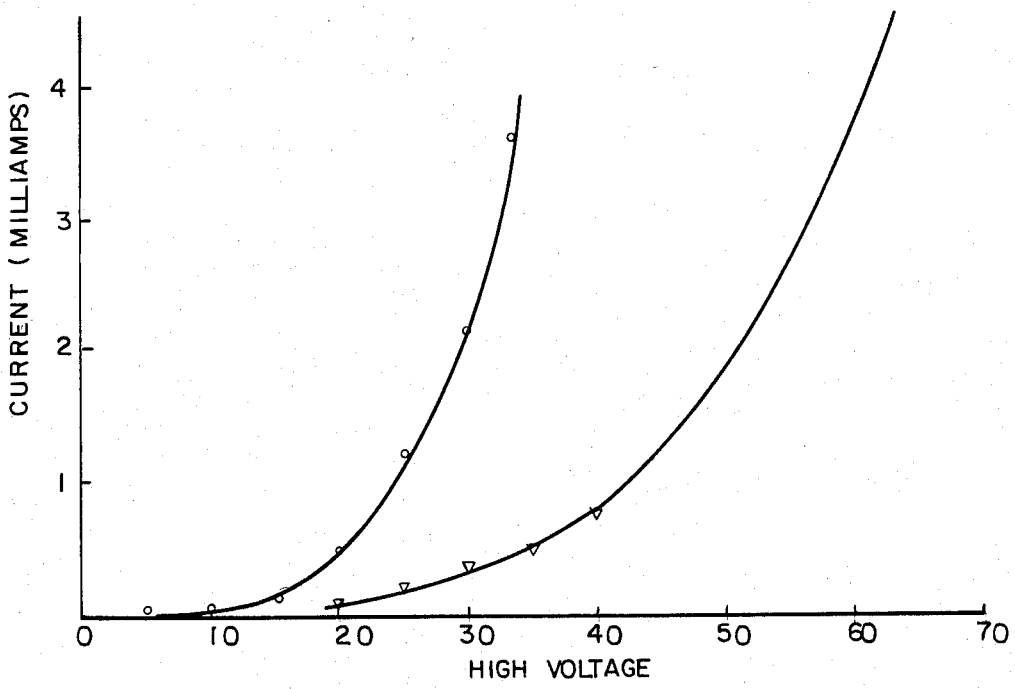
FIG. 7 is a graph of coating zone current versus electrostatic field gradient within the coating zone.

FIG. 7 is a graph of electric current through the coating zone as a function of high voltage supply voltage for two different electrode-metal strip spacings. In operation, the apparatus is adjusted to supply currents in excess 1 milliampere and preferably in excess of 2 milliamperes in the coating zone.

Figure 8:
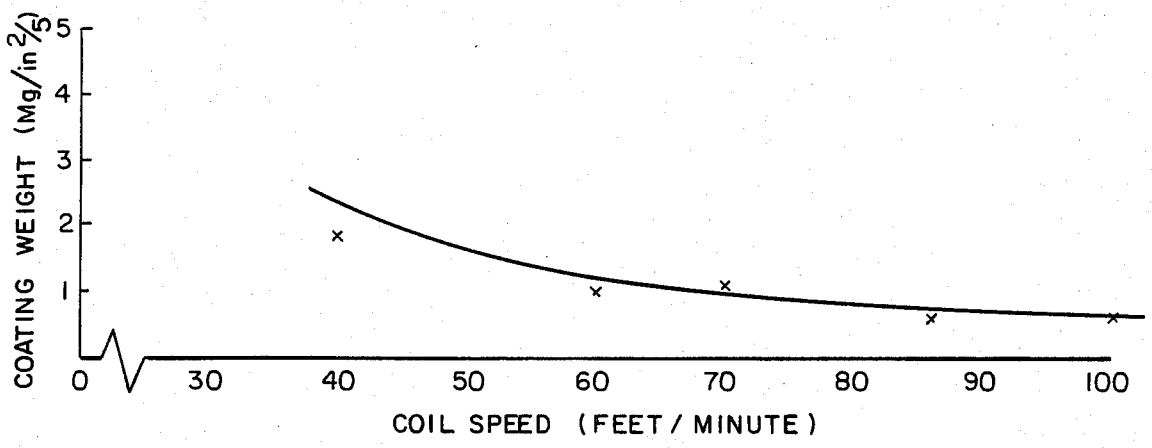
FIG. 8 is a graph of coating weight versus strip speed through the coating zone.
Figure 9:
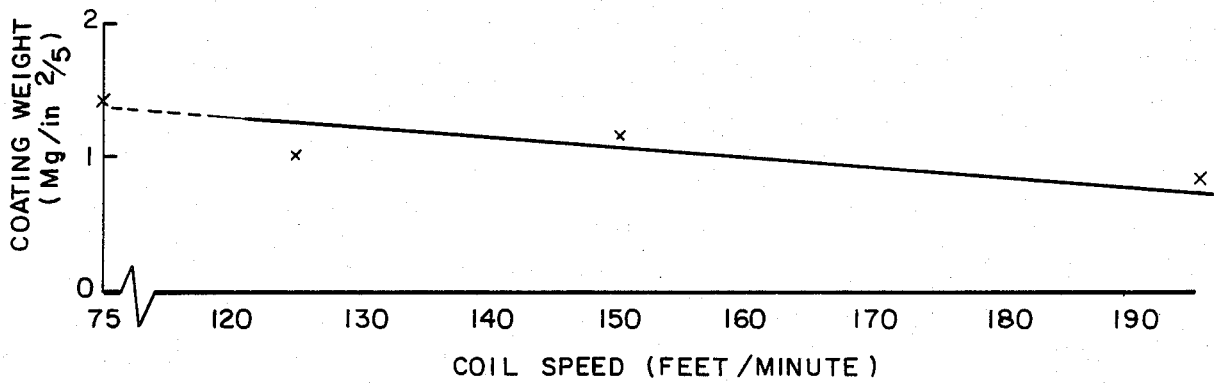
FIG. 9 is another graph of coating weight versus strip speed through the coating zone.

FIGS. 8 and 9 show the relationship of coating weight as a function of strip speed. As shown in FIGS. 8 and 9, coating weights in this process are relatively independent of coil speed; and in the process, a relative, uniform, coherent film is obtained even though the rate at which the coil is delivered through the chamber varies as much as 50 percent.

Because particles of powder may be recharged in the intense electric field and accumulate on the electrode system, it has been found desirable with some powders to produce a plurality of air jets that are periodically energized and directed at the electrodes to free them from collected powder. Such a system can include a tubular passageway having a plurality of jet-forming openings drilled tangentially through one side and directed at the electrode array from each end.

Occasionally agglomerated particles occur and are deposited before they leave the deposition chamber. One possible cause of such agglomerations may be the presence in the deposition chamber of both negative and positive electrically charged particles; for example, air ions of both charges. Because of the size and weight of these agglomerated particles, and perhaps the reduced net electric charge, the charge-to-mass ratio tends to be relatively low; and the adherence of such agglomerations to the strip is less than the unagglomerated ultra-fine particles otherwise deposited.

Agglomerations of coating material particles, if cured, provide localized thickened coating spots and an increased tendency for failure of the coating on deformation of the strip during manufacturing. To avoid the incorporation of the occasional agglomerations of coating material particles into the film, means are provided to sweep the coated strip with low-velocity jets of air.

Figure 14:
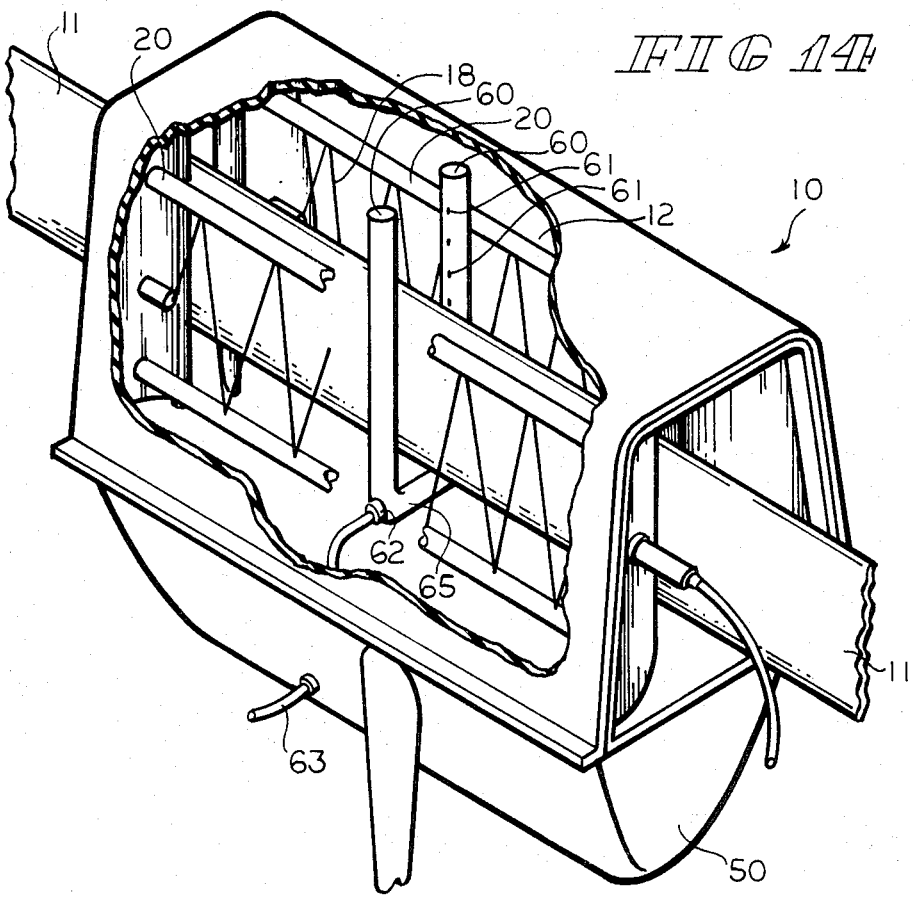
FIG. 14 is a view of such a deposition chamber means partially broken away to show means to remove occasional agglomerations from the strip.

Such means may, as shown in FIG. 14, include a compressed-air manifold 60 with a plurality of small, nozzle-like openings 61 directed at the surface of the strip. Such a manifold may be formed by a tubular pipe, for example having an outside diameter of about $\frac{1}{4}$ inch to $\frac{1}{2}$ inch. The tubular pipe may be closed at each end and provided with a hose coupling 62 to permit its pressurization from a source of compressed air (not shown) through a hose 63. The openings may be formed simply by drilling a plurality of small-diameter holes in the pipe that are equally spaced a fraction of an inch (e.g., one-eighth to three-fourths inch) and lie generally along a line.

Such a manifold having a length of 14 inches and operating at interior air pressure of 5–10 psi can effectively remove the significantly large agglomerations from the strip. Such manifolds, one on each side of the strip, are preferably located within the central part of the next to last deposition chamber of the system. The strip in the areas of the removed agglomerations is exposed to further deposition of the unagglomerated fine particles. The air jets are preferably directed in the direction of strip movement.

Figure 10:
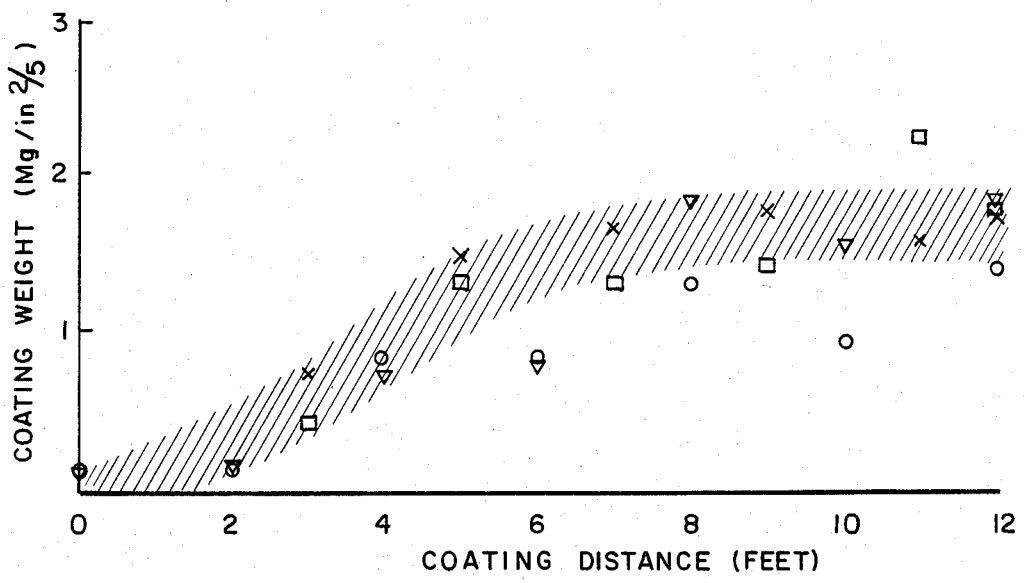
FIG. 10 is a graph representing the accumulation of coating material on can stock as a function of the distance of travel within the coating zone.

As shown in FIG. 1, the coating zone may comprise a modular array of deposition chambers 12 connected end to end to provide an elongated coating zone. A coating zone 12 feet in length has been found to be preferable since deposition is substantially completed within that length as shown in FIG. 10. The modular arrangement of coating chambers provides flexibility in the installation of the system of this invention and the ability to handle powders of varying coating characteristics.

The bottom portion of the apparatus 10 can form a downwardly extending trough 50 for the collection of powdered material which is not deposited. In the operation of this system, powdered particles that are not deposited on the particles will eventually drift to the bottom of the apparatus where they may be collected. The collected powder can be recycled and reused, thus improving the overall efficiency of the apparatus to coat a substrate in excess of 95 percent.

A wide range of materials may be used for the particulate resins to be deposited onto such substrates. These materials embrace the organic substances, such as epoxy resins and polyesters, and the inorganic substances, such as the silicone resins and polymers of boron. In particular, the non-toxic organic polymeric materials, synthetic and natural, are preferred. Resin polymers may generally be grouped into two broad classes: (I) thermoplastics and (II) thermosetting of thermocured plastics.

| | |
|---|---|
| The polymers of Group I that may be readily used include: | |
| Polyolefins | Polyethylene, polypropylene. |
| Styrene polymers | Polystyrene, styrene-acrylonitrile copolymer. |
| Acrylic polymers | Polymethyl methacrylate, methyl methacrylate/styrene copolymer. |
| Vinyl and Vinylidene polymers | Polyvinyl chloride, vinyl chloride/vinyl acetate copolymer, vinyl chloride/vinylidene chloride copolymer. |
| Polyfluorocarbons | Polytetrafluoroethylene, fluorinated ethylene/propylene copolymer, polychlorotrifluoroethylene. |
| Heterochain polymers | Nylons, linear polyesters, polycarbonates, polyformaldehyde. |
| Natural polymers and modified natural polymers | Cellulose acetate, nitrate and aceto-butyrate, ethyl cellulose. |
| The polymers of Group II include: | |
| Phenolic Resins | Phenol-formaldehyde plastics, cresol-formaldehyde. |
| Amino-Resins | Urea-formaldehyde and melamine-formaldehyde plastics. |
| Polyester Resins | Unsaturated polyester resins, alkyd materials. |
| Epoxy Resins | Epoxy modified resins |
| Urethane Resins | Flexible and rigid urethane foaming compositions. |
| Natural Resins | Shellac compositions. |

The preferred polymeric materials for stock, especially beverage container stock, are the epoxy resins. The epoxy resins or polyepoxides are polymers obtained essentially by condensing a polyhydric compound with an epihalogenohydrin such as epichlorohydrin including, for example, the condensation of a polyhydric alcohol or a dihydric phenol, e.g., bis-(4-hydroxyphenyl)dimethylmethane or diphenylol propane with epichlorohydrin under alkaline conditions. These condensation products may be prepared in accordance with methods well known in the art as set forth, for example, in U.S. Pat. Nos. 2,592,560; 2,582,985; and 2,694,694.

These epoxy resins are sold under various names, including Epon, Araldite, and Cardolite resins. Data on the Epon resins are given in the table below, and corresponds generally to those resins formed by the reaction of epichlorohydrin with bis-(4-hydroxyphenyl)-2,2-propane:

| Resin Epon Number | Epoxide Equivalent | Approximate Esterification | M.P., °C. |
|---|---|---|---|
| 1001 | 450–525 | 130 | 64–76 |
| 1004 | 905–985 | 175 | 97–103 |
| 1007 | 1,660–1,900 | 190 | 127–133 |
| 1009 | 2,400–4,000 | 200 | 145–155 |

The epoxy resins contain epoxide groups or epoxide and hydroxyl groups as their functional groups and are generally free from other functional groups such as basic and acidic groups. It will be noted that in actual practice it is necessary to react these resins with a hardener or catalyst for the purpose of effecting a cure thereof to a solid usable state. Such hardeners and catalysts are well known to those skilled in the art and include Lewis bases, inorganic bases, primary and secondary amines, amides, carboxylic acid anhydrides, diabasic organic acids, phenols, and Lewis acids. In particular, useful epoxy resin hardeners include maleic anhydride, chlorendic anhydride, trimellilic anhydride and pyromellilic dianhydride. Useful catalysts are the boron trifluoride amine complexes. The hardeners and catalysts may be admixed, if desired, as is well known to those skilled in the art, separately or in combination in an amount usually ranging from about 0.5 to 15 weight percent of the epoxy resin.

As noted above, thermosetting epoxy powders are preferably applied with apparatus of this invention. Typical of such powders are epoxy powders sold by the Glidden Company under their trade name PULVALURE 157-C-103 and 157-C-104. These epoxy resins give a smooth film at extremely low-film thicknesses. The specific gravity is in the order of 1.15, plus or minus 0.05, and the powders are chemically stable, being capable of storage for up to six months at 80° F. When applied, these powders will cure at temperatures of from 275° to 450° and form coherent films at thicknesses as small as 0.05 mils. The resulting film has properties providing 30-inch pounds direct and 30-inch pounds reverse under the Gardner impact test, has a pencil hardness of 3H, has the flexibility to pass the one-eighth inch Mandrel test, provides only 1/16 inch creepage at 1,000 hours exposure to salt spray and has limited chalking tendencies under ultraviolet exposure. All the tests were run; all the above properties were achieved when a one-tenth mil thickness of film was applied to cold-rolled, aluminum, test panels.

In operation of the system, such resin powder is delivered to the third means to produce ultra-fine resin particles at rates of 50–70 grams per minute. Where the apparatus of FIG. 5 is used, it is connected, for example, to compressed air at a pressure of 100 psig. Its resulting operation provides a flow of ultra-fine particles to the coating chamber at a rate of 50–70 grams/minute.

Figure 11:
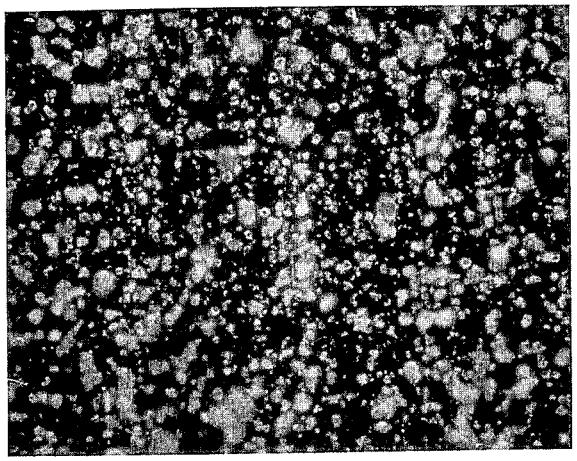
FIG. 11 is a photomicrograph of metal stock including deposited ultra-fine particles (epoxy resin) in accordance with this invention, the magnification being about 500 times.

Can stock to be coated is delivered through the coating chamber at 200 feet per minute. The electrodes are charged to a voltage of 65,000 volts and draw a current of 3–5 milliamps from the high-voltage supply, providing within the chamber an average potential gradient of 10 kilovolts per inch and an average field current density of 10–15 microamperes per square foot. The ultra-fine particles within the chamber are charged and deposited with the density of 1–16 milligrams per square inch of metal stock. The resulting stock is shown, for example, in the photomicrograph of FIG. 11 which is magnified over 504 times. As shown in the photomicrograph, the ultra-fine particles of resin are uniformly distributed over the surface.

Figure 12:
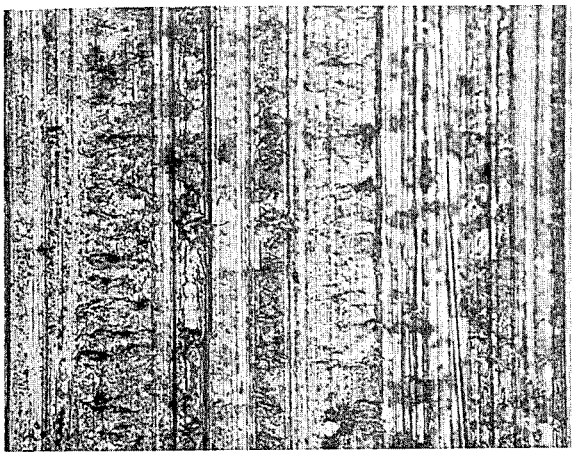
FIG. 12 is a photomicrograph of metal stock with a cured coherent film of the epoxy resin (ca. 500 times magnification)

The sheet then passes through an oven wherein it is heated to a temperature on the order of 450° F. The deposited powder particles, as shown in FIG. 12, flow out into a coherent, uniform film having a thickness of about 0.1 mil.

This invention may be embodied in other forms within the scope of the following claims.

What is claimed is:

1. A method of uniformly depositing and coating very finely divided particles of resinous powder onto a metal substrate in a deposition chamber, comprising forming an up-flowing radially outwardly extending fluid stream of gas, said radially outwardly extending fluid stream defining a narrow section and a broad section, comminuting at a zone adjacent the deposition chamber a supply of powdered material of substantially uniform bulk density, said supply being delivered in a substantially unpacked state achieved by redistribution of the powdered mass just prior to comminution, the comminuting process producing very finely divided powder particles having an average particle size less than about 10 microns, discharging and directly diffusing said comminuted powder particles to immediately cause a loss of momentum after being comminuted by immediately discharging said comminuted particles and gas directly and without interruption into the narrow and thence broad sections of said radially outwardly extending fluid stream, said outwardly extending fluid stream flowing without a substantial restriction that may cause concentration and agglomeration of the particles along the path of travel between the comminuting zone and the deposition chamber, passing said fluid and comminuted particles into an ionization zone of the deposition chamber whereby said particles are electrostatically deposited onto the substrate as discrete particles, and coalescing the particles to form a uniform coating of about 0.5 mil in thickness.

2. A method of depositing very finely divided particles of resinous powder onto a metal substrate, comprising providing a mass of powdered resinous material within a retaining means having an opening therein, introducing pressurized fluid into the mass of powdered material to impart an agitating effect on the mass within the retaining means whereby the mass assumes a substantially unpacked state, allowing a stream of the unpacked mass to exit through the opening of said retaining means, conveying the mass while still in an unpacked state into a comminuting zone whereby said powdered material is reduced to very finely divided powder particles having an average diameter of about 10 microns or less, diffusing said finely divided powder particles to immediately cause a loss of momentum by passing said finely divided particles immediately after being comminuted directly and without interruption into a radially outwardly extending stream of fluid for delivery into a deposition chamber, said outwardly extending fluid stream flowing without a substantial restriction that may cause concentration and agglomeration of the particles along the path of travel between the comminuting zone and the deposition chamber, said chamber being provided with a substrate upon which particles are to be deposited, electrostatically depositing said particles onto said substrate, and coalescing the particles to form a uniform coating of about 0.5 mil in thickness.

3. A method of claim 2 wherein the pressurized fluid is introduced from a plurality of circumferentially spaced orifices associated with said retaining means to effect a redistribution of the mass of powder material to achieve the unpacked state prior to the comminution.

4. A method of claim 2 wherein the finely divided particles are directed upwardly and radially outwardly defining a diffusing passageway and into said deposition chamber whereby the particles lose their momentum and substantially gently flow in a quiescent cloud in said chamber.

5. A method of claim 2 wherein the mass while in an unpacked state is conveyed by vibratory means into said comminuting zone.

6. A method of electrostatically coating finely divided particles of resinous powder in a deposition chamber at a substantially uniform mass rate onto a metal substrate, comprising retaining a supply of powdered material, suspending and settling said powdered material to redistribute said material into an unpacked mass having a uniform bulk density, feeding said unpacked powder into a comminuting zone to reduce the powdered material into finely divided particles having an average diameter of about 10 microns or less, discharging and directly diffusing said finely divided particles without interruption into a radially outwardly extending stream to immediately cause a loss of momentum of said finely divided powder particles after being comminuted, directing said stream and finely divided particles to said deposition chamber along a path of travel free of any substantial restriction that may concentrate and agglomerate the finely divided particles between the comminuting zone and the deposition chamber, electrostatically depositing said comminuted powder particles onto said substrate, and coalescing the powder particles to form a uniform coating of about 0.5 mil in thickness.

7. A method as in claim 6 wherein the powdered material is suspended by pressurized air.

8. A method as in claim 6 wherein the particles are discharged and diffused upwardly and radially outwardly whereby the particles lose their momentum and gently flow in a quiescent cloud during electrostatic deposition.

9. A method of providing metal stock with a very thin, coherent and lubricous coating of resinous powder, comprising:

providing an uncompacted supply of powder particles adjacent a coating zone, said uncompacted supply of powder particles being achieved by redistribution of a powdered mass;

releasing the fluid energy of a compressed gas to impart sufficient momentum to said powder particles in a comminuting zone to reduce their average particle size to 10 microns or less and carry the finely divided particles in the flowing compressed gas;

diffusing the flowing gas and reduced powder particles to provide an outwardly extending, substantially quiescent and slow-moving gas stream to maintain the reduced particles in a uniform segregated cloud and to carry said cloud directly to the coating zone, said diffusing of the flowing gas and particles being done at once and without interruption immediately after releasing the fluid energy to reduce particle size, said cloud of gas and finely divided particles flowing to the coating zone along a path that does not cause substantial concentration and agglomeration of finely divided particles;

confining said cloud of reduced particles in the coating zone, said particles having a diameter-to-weight ratio such that they will remain suspended in the substantially quiescent atmosphere of the coating zone;

moving sheet metal stock to be coated through the coating zone;

providing an electric charging and depositing field terminating on the metal stock in the coating zone having a potential gradient sufficient to charge the finely divided powder particles and deposit said particles on the metal surface while the particles are in a repelling relationship with respect to one another thereby providing a uniform distribution of particles on the metal stock; and coalescing the particles to form a uniform coating of about 0.5 mil in thickness.

10. The method of claim 9 wherein, in combination with the release of the fluid energy of a compressed gas to impart sufficient momentum to the particles to reduce their particle size, the step of releasing fluid energy of the gas through the supply of particles that is sufficient to fluidize and support them against the force of gravity.

11. The method of claim 10 wherein a flow of gas is supplied to the uncompacted particles that is sufficient to raise the particles into a plume above the level of fluidized particles, and abrade the particles on a surface above the fluidized particles to reduce them to a finely divided size prior to being carried to the coating zone.

12. A method of claim 9 wherein the average potential gradient of the electric field in the coating zone is in excess of about 6.5 kilovolts per inch and the average current density of the electrostatic field is in excess of about 15 microamperes per square foot.

13. The method of claim 12 wherein the average potential gradient is in excess of about 10 kilovolts per inch and the average current density is in excess of about 50 microamperes per square foot.

14. The method of claim 9 wherein the metal stock strip moves horizontally through the coating zone at a rate of between about 100 to 200 feet per minute with the surfaces to be coated lying in a vertical plane, and particles are deposited on the surface of the strip with a density of about 0.15 grams per square foot per side.

15. A method of providing metal stock with a uniform distribution of very finely divided particles of resinous powder, comprising:

providing a supply of resinous powder particles adjacent a coating zone;

releasing a gentle flow of gas through the supply of powder particles to permit the particles to flow freely and be redistributed to assume an unpacked state;

delivering a substantially uniform flow of said unpacked powder particles to a comminuting site;

releasing the fluid energy of a compressed gas to the flow of particles to impart sufficient momentum to said powder particles in the comminuting zone to reduce their average particle size to a very finely divided particle size of 10 microns or less;

directly diffusing the thus-formed finely divided particles and gas to cause a loss of momentum immediately after being released to provide a substantially quiescent, slowly and upwardly moving gas stream to maintain the very finely divided particles segregated in a uniform cloud and to carry said cloud to the coating zone, said upwardly moving gas stream and cloud being directed to the coating zone over a path free of restriction that may concentrate the cloud and agglomerate the particles;

confining said cloud of very finely divided particles in the coating zone, said very finely divided particles having a diameter-to-weight ratio such that they will remain suspended in the substantially quiescent atmosphere of the coating zone;

moving sheet metal stock to be coated in strip form through the coating zone;

providing an electric charging and depositing field terminating on the metal stock strip in the coating zone having a potential gradient sufficient to charge the finely divided particles and deposit said finely divided particles on the metal surface while the particles are in a repelling relationship with respect to one another thereby providing a uniform distribution of said finely divided particles on the strip; and coalescing the finely divided particles to form a uniform coating of about 0.5 mil in thickness.

16. A method of claim 15 wherein the uniform distribution of particles on the metal stock strip is heated to coalesce said particles into a continuous coating.

17. A method of electrostatically coating finely divided particles of resinous powder onto a metal substrate, comprising:

moving the substrate to be coated through a coating zone;

providing a flow of air through the resinous powdered material to enhance its flowability and to render said powdered material in an unpacked state;

feeding the flowable, unpacked powdered material to a comminuting zone adjacent to the coating zone;

reducing the powdered material into finely divided particles having an average size of about 10 microns or less and delivering a flow of finely divided particles directly after being reduced in size to the coating zone, said delivery being into a zone of increasing cross section causing an immediate diffusion after particle size reduction and subsequent communication to the coating zone over a path of travel without restricted flow that may cause particle concentration and agglomeration whereby the finely divided particles gently flow in a subsequently quiescent cloud;

electrostatically charging and depositing the finely divided particles onto the metal substrate; and coalescing the deposited particles to form a uniform coating of about 0.5 mil or less in thickness.

18. A method of claim 17 wherein the zone of increasing cross section is substantially conical.

19. A method of claim 17 wherein after electrostatically charging and depositing particles onto the surface, the surface is swept with a flow of air to remove any residual agglomeration.

20. A method of claim 17 wherein the particles are organic polymeric materials.

21. A method of claim 20 wherein the organic polymeric materials are substantially epoxy resins.

22. In a method of electrostatically coating a metal surface with a powdered resin in which the metal surface to be coated is moved through a coating zone, the coating zone is provided with a quantity of the powdered resin to be deposited, the powdered resin is electrostatically charged and deposited on the metal surface in the coating zone, and thereafter the deposited powdered resin is coalesced on said surface, the improvement, comprising:

delivering a flow of powdered resin to a comminuting site immediately adjacent the coating zone;

releasing the fluid energy of a compressed gas in the comminuting site to thereby impart sufficient momentum to the powdered resin to deagglomerate it and reduce its average particle size to about 10 microns or less;

converting the thus-formed mixture of finely divided, deagglomerated powdered resin and compressed gas immediately into an outwardly extending cloud of finely divided resin and gas flowing between the comminuting site and the coating zone along a path without a restriction that may cause concentration and agglomeration of the powdered resin to thereby maintain the segregation of the finely divided resin particles as they are carried to the coating zone and deposited on the metal surface, and coalescing the deposited particles to a uniform coating of about 0.5 mil in thickness.

23. A method of claim 22 wherein the particles are an organic polymeric material.

24. A method of claim 23 wherein the organic polymeric material is substantially an epoxy resin.

25. A method of claim 22 wherein the metal surface is swept with a flow of air prior to leaving the coating zone.

26. A method of claim 22 wherein the uniform distribution of particles on the metal strip is heated to coalesce said particles into a continuous coating.

* * * * *